US007052549B2

(12) United States Patent
Chambers et al.

(10) Patent No.: US 7,052,549 B2
(45) Date of Patent: May 30, 2006

(54) DISPENSING APPARATUS AND MANIFOLD HAVING AN ADHESIVE CATCH GROOVE

(75) Inventors: Jerry Chambers, Cleveland, GA (US); Mark A. Gould, Gainesville, GA (US); Kenneth Jones, Marietta, GA (US)

(73) Assignee: Nordson Corporation, Westlake, OH (US)

( * ) Notice: Subject to any disclaimer, the term of this patent is extended or adjusted under 35 U.S.C. 154(b) by 99 days.

(21) Appl. No.: 10/831,073

(22) Filed: Apr. 22, 2004

(65) Prior Publication Data

US 2005/0235911 A1 Oct. 27, 2005

(51) Int. Cl.
*B05C 5/00* (2006.01)

(52) U.S. Cl. ..... 118/313; 118/300; 222/108; 222/571

(58) Field of Classification Search ..... 222/108–110, 222/571, 504; 239/290, 296, 298; 118/315, 118/325, 300, 302, 313; 156/578
See application file for complete search history.

(56) References Cited

U.S. PATENT DOCUMENTS 4,600,128 A * 7/1986 Rohrer ..... 222/108

* cited by examiner

*Primary Examiner*—Brenda A. Lamb
(74) *Attorney, Agent, or Firm*—Wood, Herron & Evans, L.L.P.

(57) ABSTRACT

A manifold for distributing liquid and process air to at least one dispensing module including a manifold body adapted to overlie at least a portion of a substrate. The manifold body includes a front surface having a liquid outlet vertically spaced above a process air outlet. The front surface of the manifold body is configured to carry at least one dispensing module having a liquid inlet and a process air inlet in communication with the liquid outlet and process air outlet in the manifold body. A groove is formed in the front surface of the manifold body between the liquid outlet and process air outlet and adapted to collect any liquid dripping from the liquid outlet toward the process air outlet when the dispensing module is removed from the manifold body thereby preventing the liquid from reaching the process air outlet.

7 Claims, 3 Drawing Sheets

DISPENSING APPARATUS AND MANIFOLD HAVING AN ADHESIVE CATCH GROOVE

FIELD OF THE INVENTION

The present invention generally relates to liquid material dispensing systems, and more specifically to applicators for dispensing a liquid material onto a substrate.

BACKGROUND OF THE INVENTION

Various liquid dispensing systems have been developed for the precise application of a heated liquid onto a substrate. Dispensing systems for supplying liquid material in the form of filaments or other patterns are known in the art. These dispensing systems are conventionally used to apply thermoplastic materials, such as a hot melt adhesive, to various substrate materials during the manufacturing of diapers, sanitary napkins, surgical drapes, and other products. Typically, liquid material and pressurized process air are supplied to the dispensers where they are heated and distributed to one or more dispensing modules for application to the substrate. The heated liquid material is discharged from the dispensing module while pressurized process air is directed toward the dispensed liquid to attenuate or draw down the dispensed liquid material and to control the pattern of the liquid material as it is applied to the substrate.

Conventional liquid dispensing systems typically utilize a manifold for heating and distributing the pressurized process air and liquid material to the dispensing modules. The manifold generally has a block configuration having a pair of opposed front and rear surfaces, a pair of opposed end surfaces, and opposed upper and lower surfaces. The manifold is configured to accommodate a number of dispensing modules that releasably couple to the manifold. The dispensing modules may, for example, span the front surface. In any event, for each dispensing module coupled to the manifold, the manifold has a liquid passage ending in a liquid outlet for feeding heated liquid to the dispensing module and a process air passage ending in a process air outlet for feeding heated process air to the dispensing module. The dispensing module includes a liquid inlet and a process air inlet that communicate with the liquid outlet and process air outlet in the manifold. The dispensing module further includes a pneumatically or electrically actuated valve assembly for metering a precise quantity of the liquid and discharging the metered amount through a small-diameter dispensing orifice and onto a typically moving substrate positioned below the orifice.

During maintenance of the liquid dispensing system, such as when the dispensing modules become clogged with debris or a different dispensing module is to be used for a specific application, a dispensing module will be removed from the manifold. During the maintenance of the liquid dispensing system the system is not hydraulically pressurized, however, residual or hydrostatic pressure often causes a small amount of liquid to drip from the liquid outlets of the manifold and down the front surface. Because the dispensing modules are generally vertically oriented, the liquid outlet is positioned vertically above the process air outlet in the manifold. Thus, liquid that drips from the liquid outlet flows down the front surface of the manifold and may enter and pool in the process air outlet and adjacent passage.

In the normal course, a new or repaired dispensing module is simply reattached to the manifold and the system is powered back up for production without removing the liquid from the process air outlet. Attempts may be made to remove the liquid (which may have solidified) from the process air outlet and adjacent passage, but frequently fail due to the difficulty in removing enough of this liquid. Liquid in the process air passage and outlet may result in a blocked process air outlet. This prevents the desired pattern from being formed on the substrate resulting in scrap product. Moreover, liquid in the process air outlet may cause the process air passageways in the dispensing module to become clogged. In any event, the liquid dispensing system must be shut down to repair or replace the damaged dispensing modules, thereby increasing system downtime and increasing overall production costs.

A need therefore exists for an improved liquid material dispensing system which overcomes various drawbacks of prior dispensing systems, such as those described above.

SUMMARY OF THE INVENTION

The present invention provides a manifold for distributing liquid and process air to at least one dispensing module from where the liquid is dispensed onto a substrate. To this end, the manifold includes a manifold body adapted to overlie at least a portion of the substrate and includes a liquid distribution portion integrally formed with a process air distribution portion. The manifold body includes a front surface having a liquid outlet vertically spaced above a process air outlet. The front surface of the manifold body is configured to carry at least one dispensing module having a liquid inlet and a process air inlet that respectively communicates with the liquid and process air outlets in the manifold body.

During maintenance of the dispensing modules, the modules may be removed from the front surface of the manifold body so as to expose the liquid outlet and process air outlet. In many cases, residual pressure in the dispensing system causes the liquid in the passageway adjacent the liquid outlet to spill over the liquid outlet and drip down the front surface of the manifold body toward the process air outlet. To prevent the liquid from reaching the process air outlet and connected passageways, a groove is formed in the front surface between the liquid outlet and process air outlet. The liquid then enters the groove before reaching the process air outlet and is collected and drained away from the manifold body.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
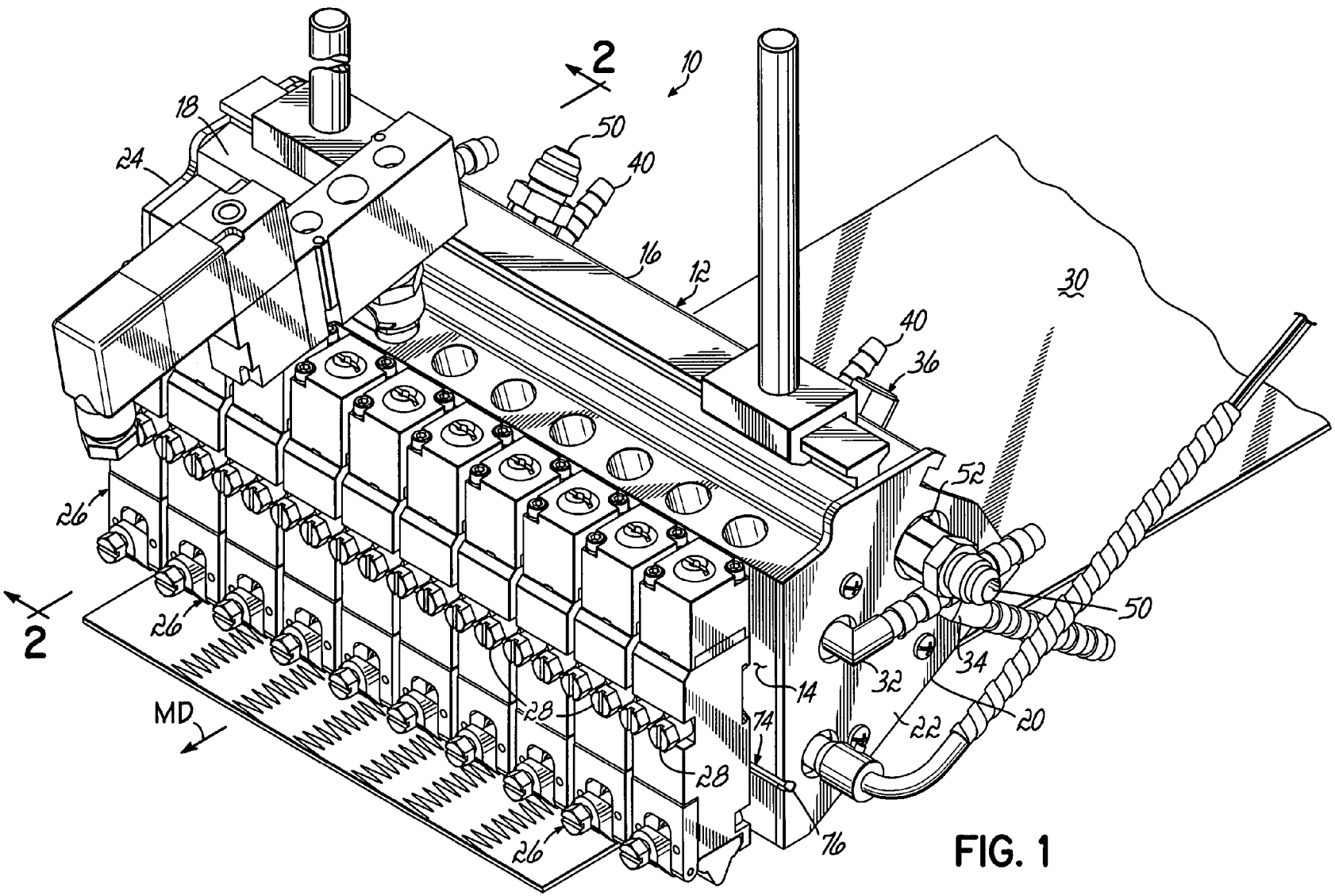
FIG. 1 is a perspective view of an exemplary liquid dispenser of the present invention.

Referring to FIG. 1, there is shown an exemplary liquid material dispensing system 10 according to the present invention. The liquid material dispenser 10 includes a unitary manifold body 12 which has been formed and machined to accommodate the various components of the liquid dispensing system, as will be described more fully below. The manifold body 12 has oppositely disposed front and rear surfaces 14, 16, oppositely disposed upper and lower surfaces 18, 20, and oppositely disposed end surfaces 22, 24.

Several liquid dispensing modules 26 are secured to the front surface 14 of the manifold body 12 by fasteners 28. The dispensing modules 26 may be on/off-type modules with internal valve structure (FIG. 2) for selectively dispensing liquid material in the form of one or more filaments or beads. An exemplary module of this type is disclosed in U.S. Pat. No. 6,089,413, commonly assigned to the assignee of the present invention and incorporated herein by reference in its entirety.

Liquid material, such as hot melt adhesive, and pressurized process air are supplied to the individual modules 26 through the manifold body 12 to thereby dispense beads or filaments of the liquid material onto a substrate 30. The substrate 30 is positioned along a moving conveyor system (not shown) that passes the substrate 30 beneath the lower surface 20 of the manifold body 12 and the dispensing modules 26 in a machine direction as indicated by the arrow. The substrate may have a panel configuration so as to span the length of the manifold body, as shown in FIG. 1. The invention, however, is not so limited and, as is known by those skilled in the art, the substrate may generally be any material to which an adhesive is to be applied including, for example, individual elastic strands. The dispenser 10 further includes liquid material heaters 32 and process air heaters 34 for heating the process air and liquid material. Filters 36 are installed in the manifold body 12 to filter out contaminants from the liquid material supplied to the modules 26.

Figure 2:
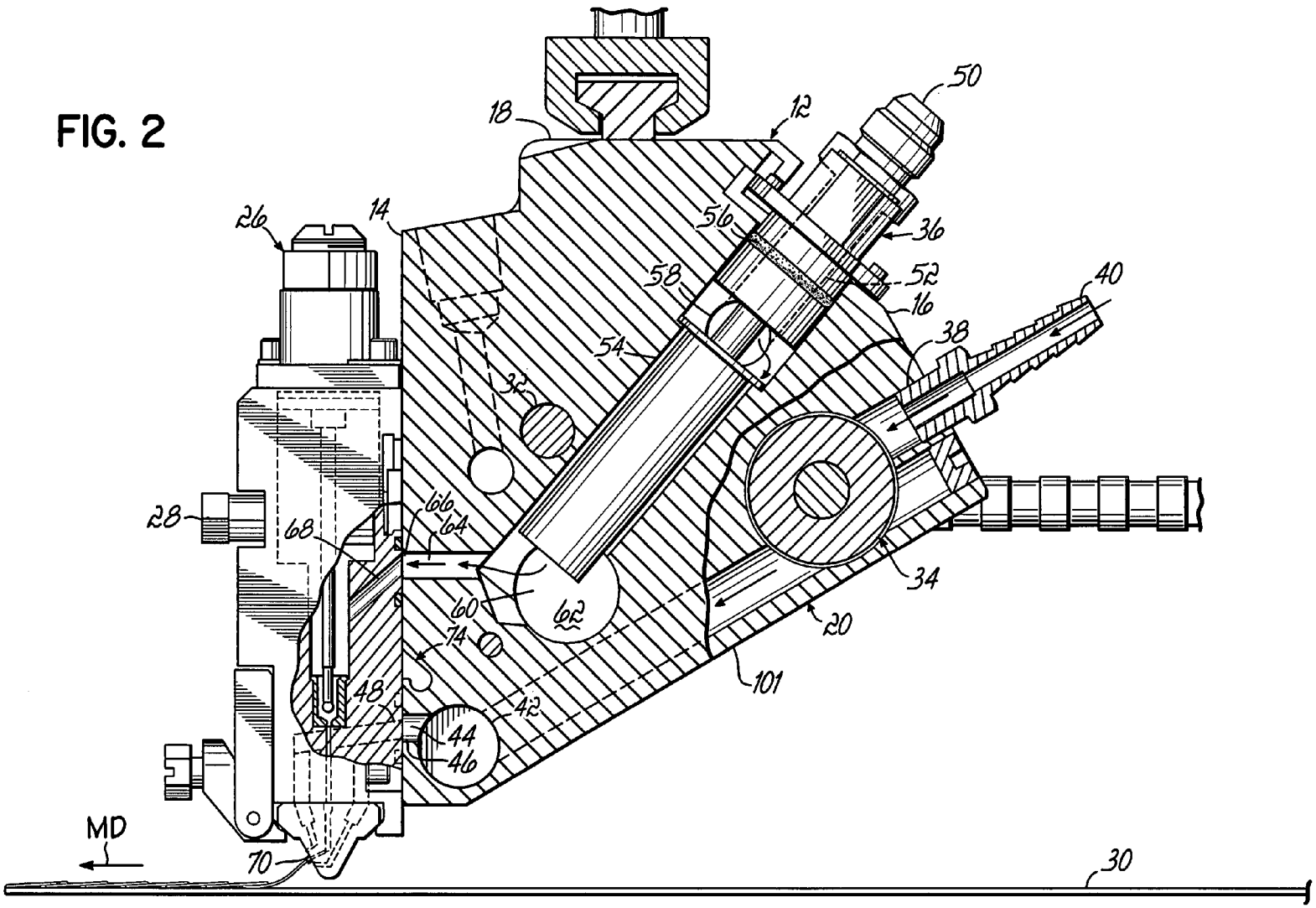
FIG. 2 is a cross-sectional view of the liquid dispenser of FIG. 1 taken along line 2—2.

Referring now to FIG. 2, there is shown a cross-sectional view of the liquid dispenser 10 of FIG. 1. Process air is supplied to the dispenser 10 from a source of pressurized air (not shown) and is routed to the individual modules 26 through a series of interconnected passages. Process air enters the dispenser 10 through an air inlet port 38 formed in the rear surface 16 of the manifold body 12. A fitting 40 coupled to the air inlet port 38 facilitates the attachment of an air line connected to the pressurized air source. The process air is heated by heater 34, such as that described in co-pending U.S. patent application Ser. No. 10/830,613 titled "Integral Manifold for Liquid Material Dispensing Systems," having a reference number NOR-1181, Express Mail No. EV371410885US, filed on Apr. 22, 2004 and assigned to the assignee of the present invention. After being heated, the process air enters a distribution passage 42 extending through the manifold body 12 and along the direction parallel to the bank of liquid dispensing modules 26. A plurality of air outlet passages 44 are formed in the front surface 14 of the manifold body 12 and intersect the air distribution passage 42 whereby process air may be provided from the air distribution passage 42 through the outlet passages 44 to each module 26 secured to the front surface 14 of the manifold body 12. The outlet passages 44 terminate at process air outlets 46 in the front surface 14 of manifold body 12. Each module 26 includes a process air inlet 48 which confronts and communicates with the process air outlet 46 when the dispensing modules 26 are secured to the front surface 14 of the manifold body 12.

With continued reference to FIG. 2, liquid material is supplied to the manifold body 12 through a fitting 50 coupled to a liquid material inlet port 52 at the rear surface 16 and/or side surface 22 of the manifold body 12. The liquid inlet port 52 leads to a filter cavity 54 formed in the rear surface 16 of the manifold body 12 and sized to receive a filter 36 for removing contaminants from the incoming liquid material. The filter 36 has an O-ring 56 to seal the upper end of the cavity 54. The filter 36 depicted in this embodiment is more fully shown and described in co-pending U.S. patent application Ser. No. 10/831,016, titled "A Filter Assembly for a Liquid Dispensing Apparatus," having a reference number NOR-1184, Express Mail No. EV372583247US, filed on Apr. 22, 2004 and assigned to the assignee of the present invention. Liquid material enters the filter 36 through circumferentially spaced inlets 58 and circulates through the filter 36 whereafter filter liquid material exits toward the bottom 60 of the filter cavity 54. Thereafter, the liquid material enters a liquid distribution passage 62 communicating with the filter cavity 54 and extending longitudinally along the manifold body 12, adjacent the bank of liquid dispensing modules 26 and generally parallel to the process air distribution passage 42. A plurality of liquid outlet passages 64 are formed into the manifold body 12 from the front surface 14 and intersect the liquid distribution passage 62 where by liquid material flows from the liquid distribution passage 62, through the liquid outlet passages 64 and to each of the dispensing modules 26 mounted on the front surface 14 of the manifold body 12. The liquid outlet passages 64 terminate at liquid outlets 66 in the front surface 14 of the manifold body 12. Each module 26 includes a liquid inlet 68 which confronts and communicates with the liquid outlet 66 when the dispensing modules 26 are secured to the front surface 14 of the manifold body 12. As more fully described in co-pending U.S. patent application Ser. No. 10/830,613, titled "Integral Manifold for Liquid Material Dispensing Systems," having a reference number NOR-1181, Express Mail No. EV371410885US, filed on Apr. 22, 2004, as the liquid flows through the liquid passageways, including passageways 54, 62, 64, the liquid is heated by liquid heater 32. The liquid material travels through various liquid passages formed in dispensing modules 26 and is discharged from one or more liquid discharge orifices 70 in dispensing module 26, as is known in the art.

Figure 3:
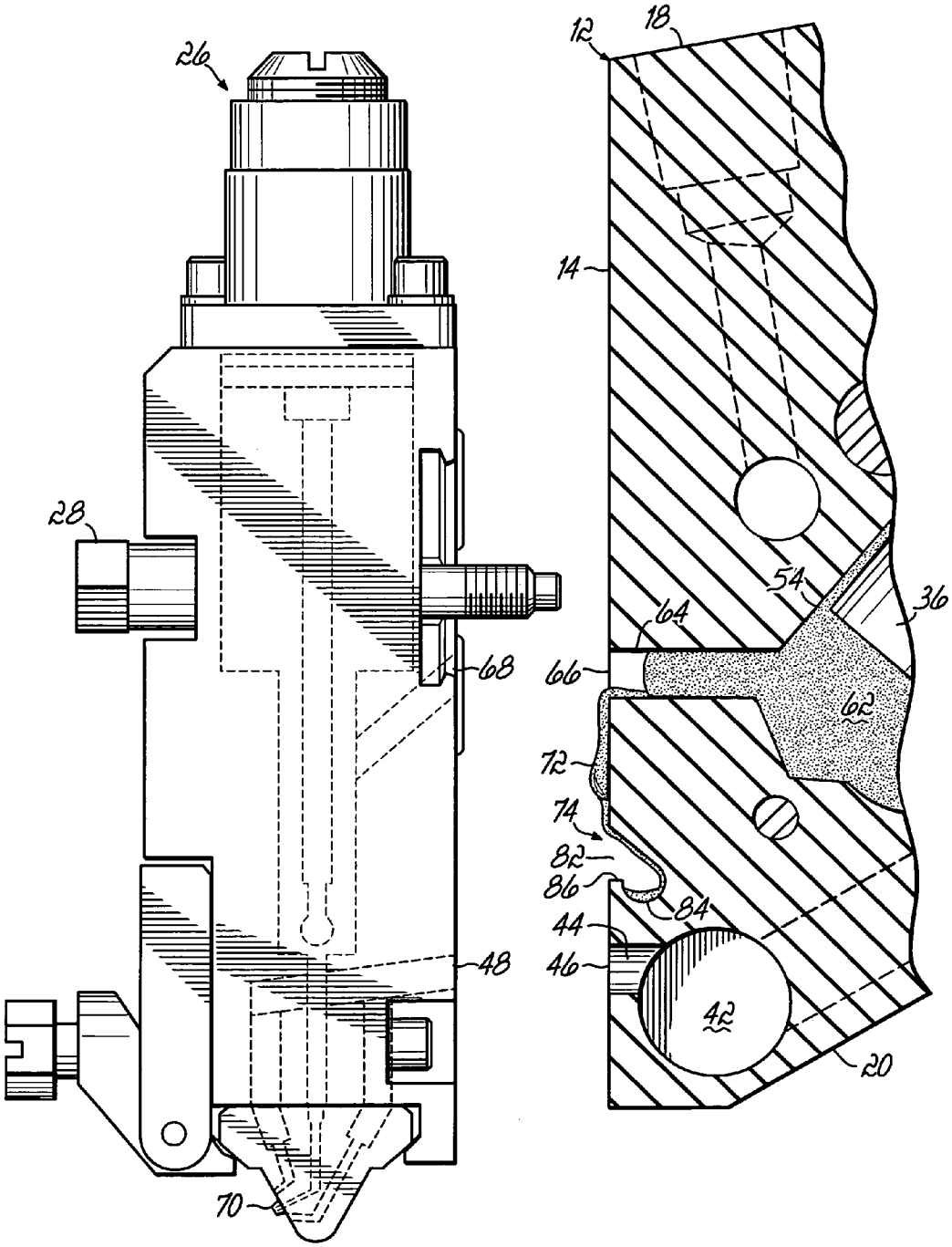
FIG. 3 is an enlarged view of the liquid dispenser of FIG. 2 during removal of a dispensing module.

Referring now to FIG. 3, during maintenance of the dispensing system 10, one or more of the dispensing modules 26 may be removed from the front surface 14 of the manifold body 12 by loosening fasteners 28. When the dispensing module 26 is removed, the liquid in the liquid outlet passages 64 will often flow over liquid outlet 66 due to residual or hydrostatic pressure in the system and cause a liquid portion 72 to drip down the front surface 14 of the manifold body 12. To prevent liquid portion 72 from reaching the process air outlet 46, a recess or groove 74 is advantageously formed in the front surface 14 of the manifold body 12 between the liquid outlet 66 and the process air outlet 46. In this way, as liquid portion 72 drips down the front surface 14 of the manifold body 12, it is received by and collected in the groove 74 thereby preventing any further advance toward the process air outlet 46. The groove 74 preferably extends in the longitudinal direction along the manifold body 12 from one end surface 22 to the opposed end surface 24 and may include an opening 76 (FIG. 1) in one or both end surfaces 22, 24. Furthermore, the groove 74 may be slightly angled by having one end positioned above the other end. In this way, liquid portion 72 collected in the groove 74 may flow to one of the end surfaces 22, 24 where the liquid can be drained or otherwise removed from the manifold body 12.

As shown in FIG. 3, the groove 74 includes an opening 82 in the front surface 14 of the manifold body 12. The liquid portion 72 dripping down the front surface 14 is intercepted by the opening 82 and received by the groove 74 through opening 82. The groove 74 further includes a bottom portion 84 formed internal to the manifold body 12 and connected to the opening 82. The bottom portion 84 of the groove 74 is configured to hold the liquid portion 72 received through the opening 82. To this end, the bottom portion 84 includes at least a portion below the opening 82 so as to prevent liquid portion 72 received through opening 82 from spilling over the bottom edge 86 of the opening 82, thereby traversing groove 74, and subsequently reaching the process air outlet 46. Advantageously, the bottom portion 84 may have a semicircular shape or otherwise be arcuately shaped to minimize corners and enhance the cleaning and/or draining of liquid from the groove 74. The groove 74 may be formed in the manifold body 12 through machining, or preferably, as a part of the manufacturing process of the manifold body 12 by extrusion.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A manifold configured to distribute liquid and process air to a dispensing module, comprising:

a manifold body adapted to overlie at least a portion of a substrate and having a liquid distribution portion integrally formed with a process air distribution portion, said manifold body including a front surface having a liquid outlet vertically spaced above a process air outlet, said front surface of said manifold body configured to carry at least one dispensing module having a liquid inlet and a process air inlet for respectively communicating with said liquid and process air outlets; and a groove formed in said front surface between said liquid outlet and said process air outlet, said groove adapted to collect any liquid dripping from said liquid outlet toward said process air outlet when the dispensing module is removed from said manifold body thereby preventing the liquid from reaching said process air outlet.

2. The manifold of claim 1, wherein said manifold body further comprises:

spaced apart first and second end surfaces, said front surface extending between said first and second end surfaces, said groove extending between said first and second end surfaces.

3. The manifold of claim 1, wherein said groove has first and second ends, said groove being angled so that said first end is above said second end, said angled groove adapted to cause the liquid collected in said groove to flow to said second end of said groove.

4. The manifold of claim 3, wherein said second end of said groove is positioned at an end of said front surface.

5. The manifold of claim 1, wherein said groove comprises:

an opening in said front surface adapted to receive the liquid dripping from the liquid outlet; and a bottom portion formed in said manifold body and connected to said opening, said bottom portion positioned generally below said opening and adapted to collect the liquid received through said opening.

6. The manifold of claim 5, wherein said bottom portion is arcuate.

7. The manifold of claim 1, wherein said groove is an extruded portion of said manifold body.

* * * * *